US010293192B2

(12) United States Patent
Horne et al.

(10) Patent No.: US 10,293,192 B2
(45) Date of Patent: May 21, 2019

(54) HYDRAULIC IMPLEMENT

(71) Applicant: LUKAS Hydraulik GmbH, Erlangen (DE)

(72) Inventors: Tammy Horne, Gastonia, NC (US); Carsten Sauerbier, Lauf (DE); Christopher Jaques, Fort Mill, SC (US)

(73) Assignee: LUKAS Hydraulik GmbH, Erlangen (DE)

( * ) Notice: Subject to any disclaimer, the term of this patent is extended or adjusted under 35 U.S.C. 154(b) by 0 days.

(21) Appl. No.: 15/546,228

(22) PCT Filed: Jan. 26, 2015

(86) PCT No.: PCT/EP2015/051510

§ 371 (c)(1),
(2) Date: Jul. 25, 2017

(87) PCT Pub. No.: WO2016/119819

PCT Pub. Date: Aug. 4, 2016

(65) Prior Publication Data

US 2018/0021603 A1 Jan. 25, 2018

(51) Int. Cl.
*B66F 3/44* (2006.01)
*A62B 3/00* (2006.01)
(Continued)

(52) U.S. Cl.
CPC ..... *A62B 3/005* (2013.01); *B25B 28/00* (2013.01); *F15B 11/10* (2013.01); *F15B 15/06* (2013.01)

(58) Field of Classification Search
CPC ..... B66F 3/00; B66F 3/38; B66F 3/24; B66F 3/28; B66F 3/44
See application file for complete search history.

(56) References Cited

U.S. PATENT DOCUMENTS 444,301 A 8/1891 Myers
4,392,263 A * 7/1983 Amoroso ..... A62B 3/005 29/566.1
(Continued)

FOREIGN PATENT DOCUMENTS

DE 92 15 062 U 12/1992
DE 692 21 221 T2 11/1997
(Continued)

OTHER PUBLICATIONS

International Search Report and Written Opinion of the International Searching Authority for corresponding International Patent Application No. PCT/EP2015/051510 dated Nov. 4, 2015, 19 pages.
(Continued)

*Primary Examiner* — Lee D Wilson
(74) *Attorney, Agent, or Firm* — Merchant & Gould P.C.

(57) ABSTRACT

A hydraulic implement (1) for portable use includes a hydraulic pump (2), a pump housing (10), a hydraulic cylinder (3) with a piston rod (11), a hydraulic tank (4), hydraulic lines, a compensating device, a manually operable hydraulic control valve (8), a rechargeable battery (9) which is accommodated on the implement (1), and two tool halves (16, 17) that are connected to the piston rod (11) via pivoting arms (12, 13). Each tool half (16, 17) has a wall section (20, 21) that extends perpendicularly to the extension of the longitudinal axis of the piston rod (11). When the tool halves are closed, both wall sections (20, 21) together form a flattened end region (24) that runs perpendicularly to the extension of the longitudinal axis of the piston rod (11).

17 Claims, 9 Drawing Sheets

(51) Int. Cl.

| | |
|---|---|
| ***B25B 28/00*** | (2006.01) |
| *F15B 11/10* | (2006.01) |
| *F15B 15/06* | (2006.01) |

(56) References Cited

U.S. PATENT DOCUMENTS

| | | | | |
|---|---|---|---|---|
| 4,762,304 | A * | 8/1988 | Hill | A62B 3/005 254/100 |
| RE33,002 | E * | 8/1989 | Brick | A62B 3/005 30/134 |
| 5,272,811 | A | 12/1993 | Armand | |
| 5,297,780 | A * | 3/1994 | Hickerson | A62B 3/005 254/124 |
| 5,398,773 | A * | 3/1995 | Baker | A62B 3/005 173/202 |
| 6,311,537 | B1 | 11/2001 | Vigil | |
| 7,568,372 | B1 * | 8/2009 | Patton | A62B 3/005 72/453.15 |
| 8,727,317 | B2 * | 5/2014 | Lindner | A62B 3/005 254/89 H |
| 2008/0093587 | A1 * | 4/2008 | Sodini | B21D 1/12 254/124 |
| 2011/0214471 | A1 | 9/2011 | Wettlaufer et al. | |

FOREIGN PATENT DOCUMENTS

| | | | |
|---|---|---|---|
| DE | 20 2005 008 658 | U | 11/2005 |
| DE | 101 10 882 | B4 | 4/2011 |
| EP | 0 419 810 | A1 | 4/1991 |
| EP | 0 519 845 | A1 | 12/1992 |
| EP | 2 700 863 | B1 | 10/2016 |
| JP | 2004-082273 | A | 3/2004 |
| WO | 96/34657 | A1 | 11/1996 |

OTHER PUBLICATIONS

Lukas Hydraulik et al., "Ersatzteilliste / Spare Parts List", eDraulic-Kombigerat / eDraulic combi tool, SC 357 E2, 13 pages (2014).
"Agregat" presented a rescue device SZ-Z at the International Salon "Integrated Security—2013", Agregate Press Release, 4 pages (2013), http://www.agregat-avia/ru/press-tsentr/news/252.
"70 years heading for the heights", Agregate, 5 pages (admitted prior art), http://www.agregat-avia.ru/produktsija/avarijjno-spasatelnyjj-instrument/.
"Blockbuster and Lip Tips", Hurst Jaws of Life, 1 page (2002).
Power Hawk Rescue Systems on the Job Around the World, Power Hawk Technologies, Inc., 2 pages (2012).
"Battery Tools E-Force", Weber Rescue Systems, 5 pages (2012).
Weber "Kombigerat S33-14", Operating Instructions Hydraulic rescue equipment, Weber Rescue Systems, 53 pages (admitted prior art).
European Search Report for corresponding European Patent Application No. 18191723.8 dated Feb. 15, 2019, 16 pages.
Anonymous: "Catalog of hydraulic rescue equipment", 20 pages (2013), www.agregat-avia.ru, https://web.archive.org/web/20130820100232/http://www.agregat-avia.ru/upload/katgasi.pdf, treated in European Search Report dated Feb. 15, 2019 as D7.

* cited by examiner

HYDRAULIC IMPLEMENT

This application is a National Stage Application of PCT/EP2015/051510, filed 26 Jan. 2015, and which application is incorporated herein by reference. To the extent appropriate, a claim of priority is made to the above disclosed application.

TECHNICAL BACKGROUND

Hydraulic implements for portable use are usually used by fire departments for rescue operations. They comprise an electrically operated hydraulic pump, a rechargeable battery accommodated in the device, and pivoting tool halves. These are used above all for cutting body parts and for spreading and/or forcing open vehicle doors. Such devices can also be used in disaster relief, for example for rescuing victims. However, these devices are often very heavy and have relatively large dimensions, so that they are oftentimes poorly suited to mobile, universal use. What is more, the possible applications of such devices are limited by the type of tool halves used.

PRINTED PRIOR ART

One implement according to the preamble of claim 1 is known from data sheet SC 357 E2 from LUKAS Hydraulik GmbH. This known implement represents a rescue device with a cutting and spreading function and comprises two tool halves having a toothed cutting profile and forming a triangular spreading profile on the front side. The cutting profile ends at the spreading jaw.

A hydraulic unit and hydraulic circuit is known from EP 0 419 810 A1. This hydraulic unit is operated by means of a manual pump unit. A compensating device in the form of a diaphragm and the hydraulic tank are located in the extension of the cylinder housing.

DE G 92 15 062 discloses a spreading tool with exchangeable spreading jaws that form a triangular spreading profile. The spreading jaws are locked by means of removable bolts on the pivoting arms sitting on the device, so these spreading jaws can only be exchanged very slowly.

U.S. Pat. No. 8,727,317 B2 discloses an implement in the form of a hydraulic spreader for passenger cars that have been in a collision which has a hydraulic cylinder, a pump, and a rechargeable battery. The hydraulic tank and the compensating device are arranged around the hydraulic cylinder.

OBJECT OF THE PRESENT INVENTION

It is the object of the present invention to provide an implement of this generic type which enables a broadened range of application.

How the Object is Achieved

By virtue of the fact that each spreading tool half has a wall-like portion extending perpendicular to the extension of the longitudinal axis of the piston rod and the two portions form together a common, flattened front region running perpendicular to the extension of the longitudinal axis of the piston rod when the two spreading tool halves are in the closed state, it is possible to advantageously use the implement to spread open gaps in house doors or windows. In comparison to conventional handheld tools, the implement according to the invention thus enables residences or buildings to be entered very quickly using the specially designed tool.

According to the invention, the flattened front region is arranged so as to be laterally offset in relation to the extension of the longitudinal axis of the piston rod. This enables the flattened front region to be introduced without any difficulty into a door gap even in the event of unfavorable space conditions—for example, if the door gap is located in immediate proximity to a door frame.

Furthermore, the flattened front region can be oriented so as to run skew to the extension of the longitudinal axis of the piston rod. As a result, the flattened front region can be introduced more easily into a door gap in unfavorable space conditions. According to the invention, the spreading tool halves comprise a cutting profile. Using the cutting profile, it is possible, for example, to quickly cut through a security chain on the door after the door is broken open.

The two spreading tool halves widen toward the piston rod. Preferably, one spreading tool half comprises a wall region that runs at an angle to the plane of the flattened front region and intersects with the midline of the extension of the piston rod. This wall region supports the opening movement of the door or window.

The tip of the flattened front region expediently has a chamfer. This facilitates penetration of the flattened front region into an especially narrow door gap. Particularly, the chamfer also makes it easier to pound the flattened front region into a narrow door gap.

By virtue of the fact that the tool halves are arranged in the region of the flattened front region such that they engage in or over one another, an especially narrow, flattened front region can be achieved, since the spreading tool halves to not "double up" on each other in this region. On the other hand, however, due to the special shape of the first spreading tool half, sufficient force can be applied to the door gap.

The tool according to the invention advantageously has at least one flat, anvil-like wall portion at its end opposite the front region. This wall portion serves as a contact surface for actively driving the flattened front region of the tool into the door gap, for example using an axe or a hammer. This can be very advantageous if the gap is too small in order to penetrate into it with the flattened front region. Through the application of an external force, quick penetration into the door gap is possible nonetheless.

Advantageously, at least one of the flat wall portions has a contour. A crowbar can be placed on this contour, thus enabling the crowbar to be struck with a hammer or an ax. The contour offers the advantage that the crowbar does not slip from the wall portion under the force effect of the hammer or ax. A knurl can also be provided as a contour.

Advantageously, the spreading tool halves can be attached to additional tool halves. This enables the especially quick exchanging of the tools.

For example, the aforedescribed door-opening tool can be designed such that it can be attached to these additional tool halves. The two tool halves (namely, those which are attached as well as those to which attachment is performed) each have a tool function—for example, a tool function of crushing, spreading, cutting, or the like.

In order to enable the tools to be exchanged as quickly as possible, a coupling is expediently provided for attaching and detaching the spreading tool halves from the additional tool halves that comprises a locking element that can be locked and unlocked by means of a large-surface, plate-shaped actuation element. The actuation element can also be operated with thick gloves, thus ensuring the quick exchanging of tools.

The locking element is spring-loaded and engages in a hole on the additional tool half when the spreading tool half is attached to the additional tool half. After the attachment of the spreading tool half to the additional tool half, the spring holds the locking element in position. It this way, it is ensured that the spreading tool halves are not separated from one another during use. Through actuation of the actuation element, the spreading tool halves can be quickly separated from one another or pulled off.

The actuation element expediently has a preferably annular projection that is arranged opposite a corresponding hole. Upon actuation of the actuation element, the projection is pushed into the hole and the locking element located there is sunk into the hole. This enables trouble-free operation.

It is advantageous for a chamfered edge to be located at the beginning of the spreading tool half. Upon attachment of the spreading tool halves to the first additional tool halves, the chamfered edge has the effect that the locking element is sunk into the hole against the force of the spring. The locking element then remains in this hole until the spreading tool half has been pushed so far into the additional tool half that the locking element has reached the hole located in the coupling. The locking element is pressed upward by the force of the spring, thereby locking the tool halves in place.

Expediently, the additional tool halves acting as a receptacle have a—preferably toothed—cutting profile.

Advantageously, the attached spreading tool halves also have a—preferably rectilinear—cutting profile. This is especially advantageous, for example, if a cable and/or a security chain of a door has to be cut through.

It is advantageous if the cutting profile extends into the tip of the additional tool half, so that a cable can be severed with no delay without aligning the tip of the implement.

It is advantageous if the cutting profile extends into the tip of the additional tool half, so that a cable can be severed with no delay without aligning the tip of the implement.

Another expedient embodiment of the implement consists in integrating the compensating device and the hydraulic tank together in the pump housing. This guarantees an especially space-saving and weight-reducing design of the implement.

It is expedient if the pump housing has a lid that forms a space together with the pump housing in which the compensating device is located—in the form of a rubber diaphragm, for example—and can extent into this space depending on the specific application. Structurally speaking, this embodiment is especially simple.

It is expedient for a holding fixture for an illumination unit to be located on the pump housing. This is expedient when the implement is used in total darkness, for example by a special task force or in poor visibility conditions. In this way, the operator can be assured of a certain level of illumination of the workspace.

The illumination unit preferably has its own power supply. The separation of the power supply has the advantage that the rechargeable battery for the pump cannot be used up by the illumination unit.

DESCRIPTION OF THE INVENTION ON THE BASIS OF EXEMPLARY EMBODIMENTS

Expedient embodiments of the present invention are explained in further detail below with reference to drawings.

Figure 8A:
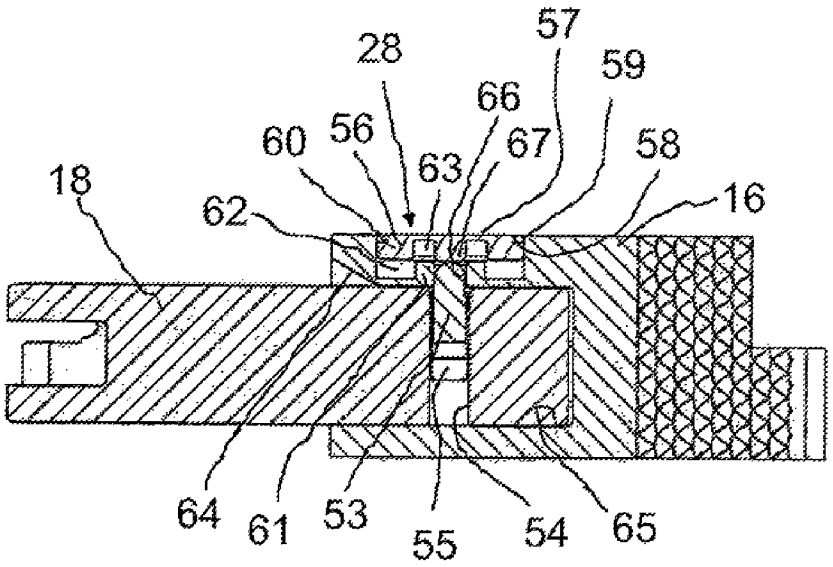
Figure 8B:
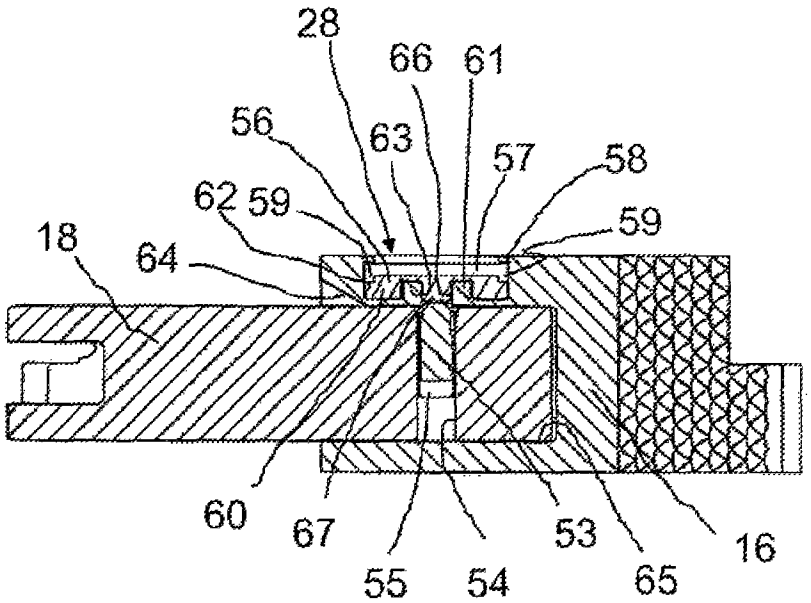
Figure 8C:
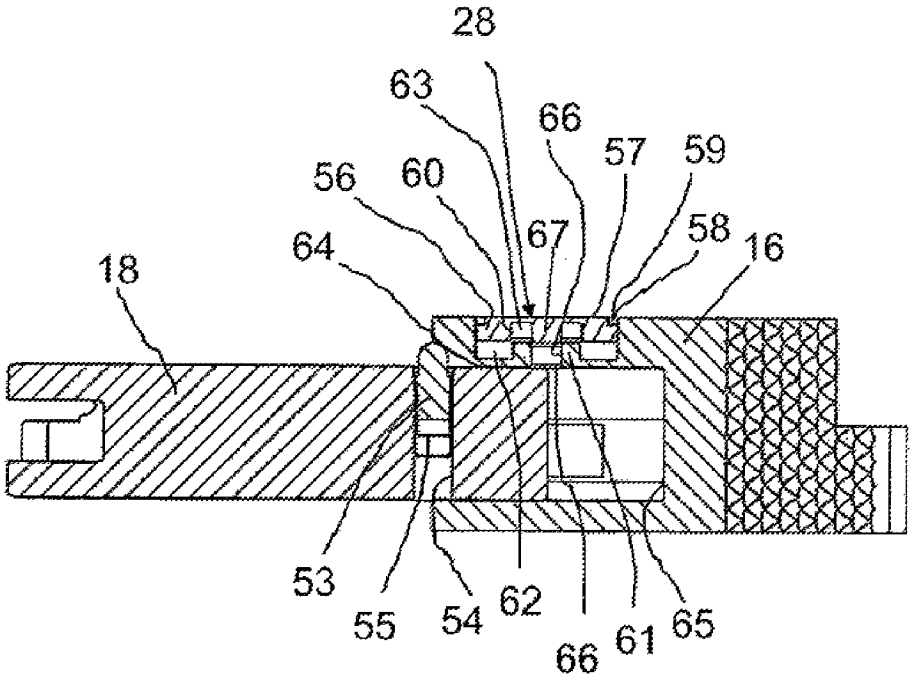

FIG. 8*a* shows a sectional view in the region of the connection between additional tool half and spreading tool half in the locked state;

FIG. 8*b* shows a sectional view in the region of the connection between additional tool half and spreading tool half in the unlocked state; and FIG. 8*c* shows a sectional view in the region of the connection between additional tool half and spreading tool half, with the spreading tool half pulled partially off.

Figure 1:
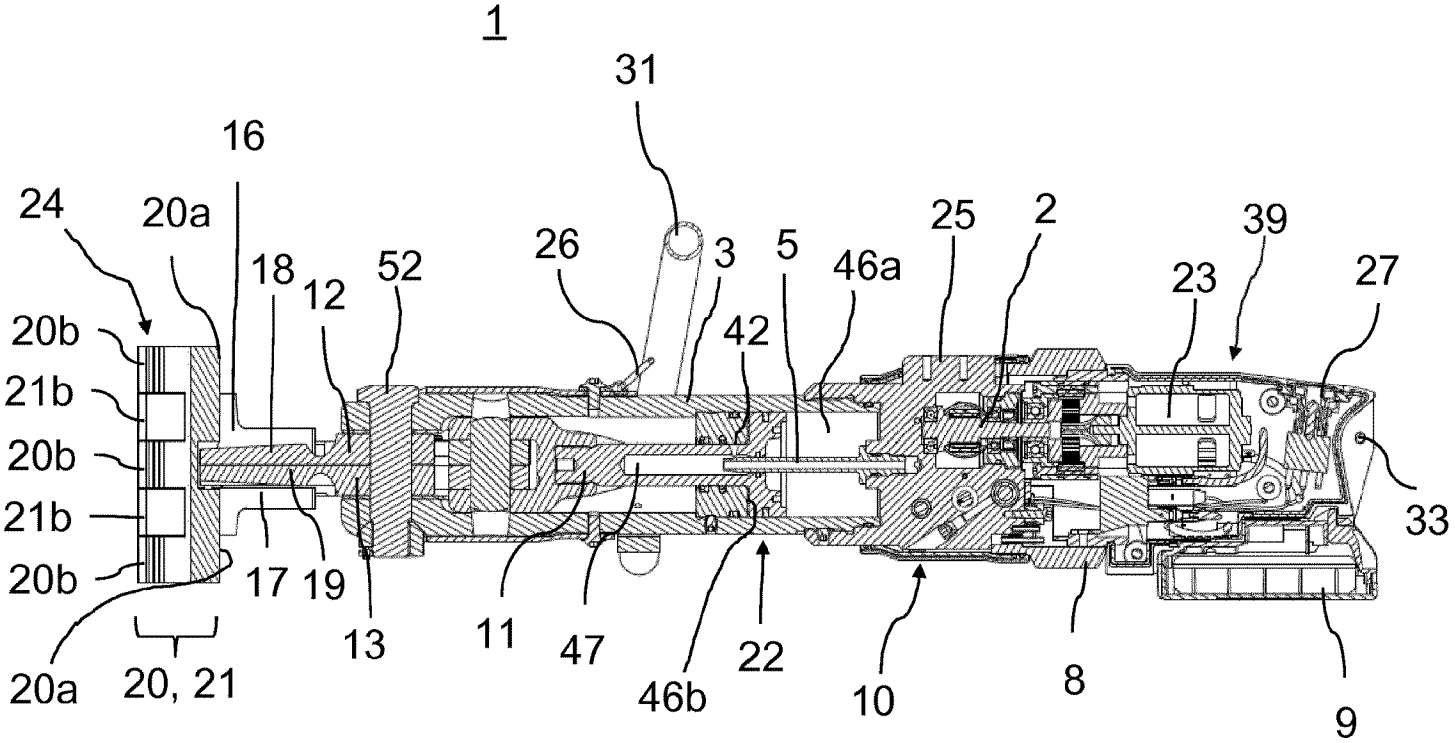
FIG. 1 shows a longitudinal sectional view of a first embodiment of a hydraulic implement according to the invention.

Reference number 1 in FIG. 1 refers to the portable hydraulic implement according to the invention in its entirety. The implement 1 comprises a motor housing 39, a pump housing 10, a cylinder housing 22, and a front-side door-opening tool driven by the implement. An electric motor 23 for driving a hydraulic pump 2 that is accommodated in the pump housing 10 is located in the motor housing 39. To switch the implement 1 on and off, a main switch 27 is provided on the motor housing 39. A rechargeable battery 9, which is inserted in a manually detachable manner into a slot on the underside of the motor housing 39, serves as the power source.

Reference symbol 8 refers to a control valve in the form of a so-called "star valve," which is used to control the direction of flow of the hydraulic fluid and thus the working movement of the tool (opening and closing).

The cylinder housing 22 contains a first cylinder space 46*a* as well as the second cylinder space 46*b*, which are separated from one another by the piston of a piston rod 11. In FIG. 1, the piston is located in its forward end position. To enable hydraulic fluid to travel from the hydraulic pump 2 to the second cylinder space 46*b*, a hollow rod 5 is arranged securely on the pump housing 10. A hole 47 for receiving the hollow rod 5 during the movement of the piston rod 11, as well as a flow opening 42 for the hydraulic fluid into the second cylinder space 46*b*, are provided in the piston rod 11.

The end of the piston rod 11 facing away from the pump housing 10 is connected via a reversing mechanism to two pivoting arms 12, 13, which spread out or pivot toward each other depending on the direction of motion of the piston rod 11. Reference number 52 refers to a retaining pin, which simultaneously forms the pivot axis of the two pivoting arms 12, 13.

At their end facing away from the pin 52, the two pivoting arms 12, 13 are embodied as additional tool halves 18, 19 to which spreading tool halves 16, 17 are attached.

In the exemplary embodiment, the spreading tool halves 16, 17 form together a door-opening tool.

FIG. 1 also shows harness supports 26, 33, which are used to fasten a harness (not shown) to the implement 1. Furthermore, a handle 31 is provided on the implement 1.

Reference number 25 refers to a holding fixture for an illumination unit (not shown). The illumination unit is preferably equipped with its own power supply.

The two spreading tool halves 16, 17 form a tool for opening doors or windows. For this purpose, the spreading tool halves 16, 17 each comprise a perpendicularly extending wall-like portion 20, 21 with changing wall thicknesses. When the two spreading tool halves 16, 17 are in the closed state, these two portions 20, 21 form on their front side a flattened front region 24 running perpendicular to the extension of the longitudinal axis of the piston rod 11. The front region 24 is used for insertion into the gap of a house door or house window. It enables the door-opening tool to be introduced into the gap with optimal force transmission. On their rear side opposite the flattened front region 24, the two spreading tool halves 16, 17 have flat wall portions 20*a*, 21*a* with increased material thickness that are used as a contact surface for a hammer (not shown) or an axe (not shown) or as a contact extension for a rod or crowbar (also not shown).

In the embodiment according to FIG. 1, the flattened front region 24 is formed by several flattened wall portions 20*b* and 21*b*, respectively, per spreading tool half 16, 17, which engage flush in one another in the manner of fingers when the spreading tool halves 16, 17 are closed. This results in the formation of a flattened front region 24 whose vertical is greater than the diameter of the cylinder housing 22. The door-opening tool thus offers ideal force transmission into the gap of a door or window.

Figure 2:
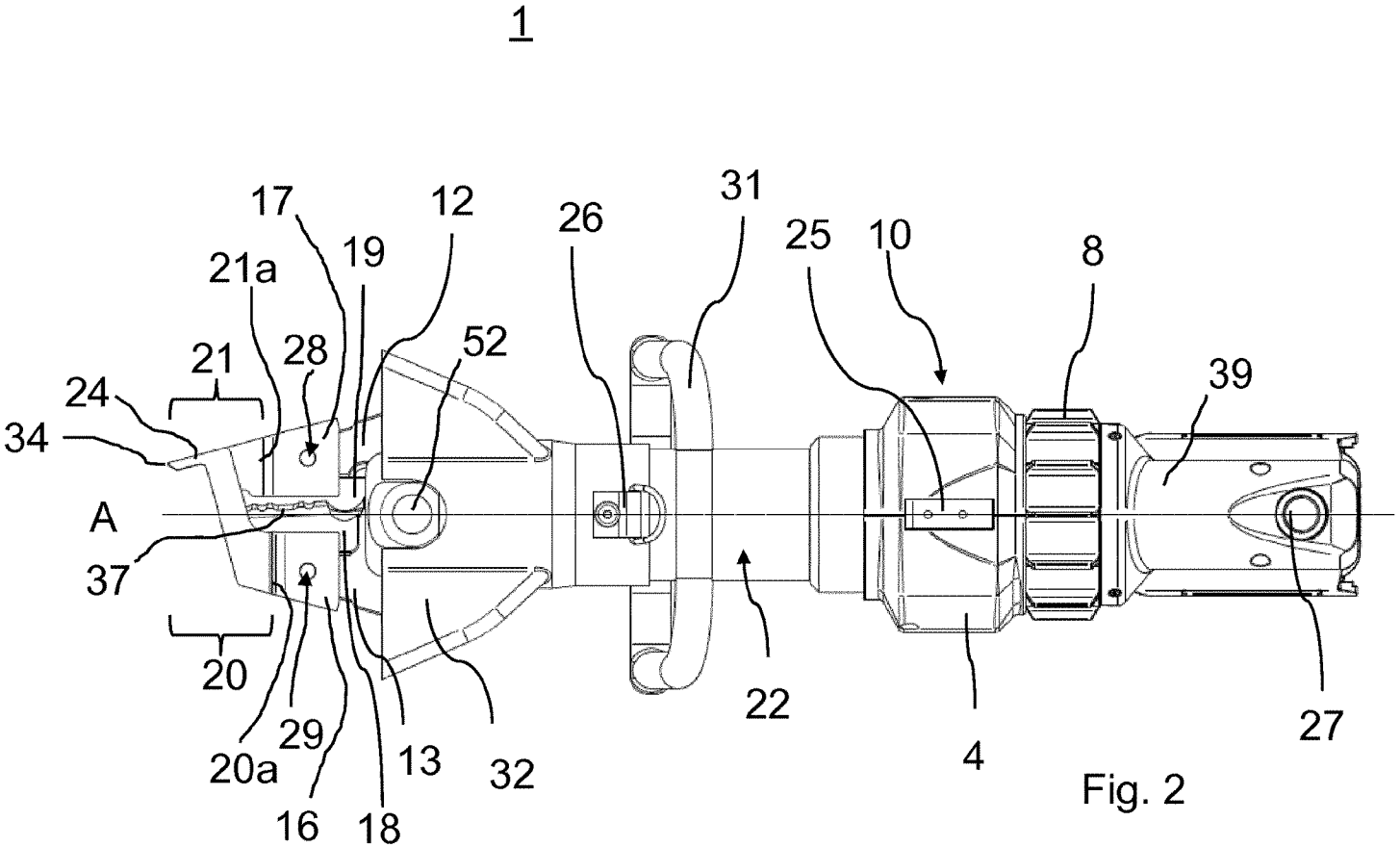
FIG. 2 shows a top view of the embodiment of the hydraulic implement according to FIG. 1.

According to FIG. 2, the flattened front region 24 of the two spreading tool halves 16, 17 is arranged so as to be offset laterally in relation to the longitudinal axis A of the implement 1 or the piston rod 11. In addition, the flattened front region 24 can be somewhat sloped toward the extension of the longitudinal axis A as needed. This design makes it possible to effectively use the implement 1 even in tight space conditions, for example on a door frame that is close to a door gap.

The front tip of the flattened front region 24 has a chamfer 34 that enables the tip of the tool to be pressed into a narrow gap of a door or window under application of force.

A hammer or an axe can be struck on the wall portions 21*a* and 20*a* running vertical in relation to the drawing plane of FIG. 2, or a contact extension provided for this purpose can be used. Reference symbol 32 refers to a cover for the two pivoting arms 12, 13 of the implement.

Figure 3:
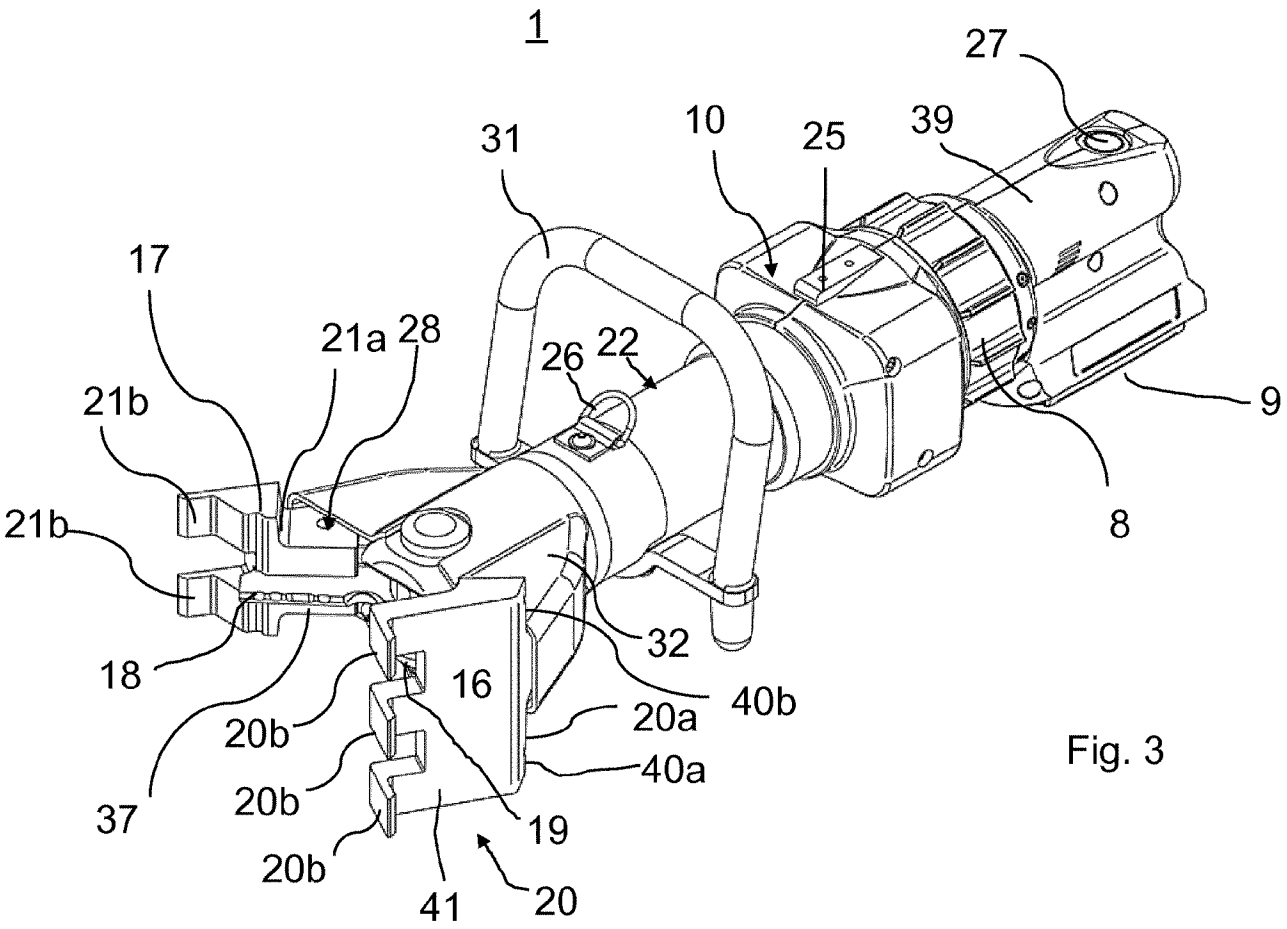
FIG. 3 shows a perspective view of the embodiment of the hydraulic implement according to FIG. 1 with opened tool halves.

FIG. 3 shows the door-opening tool in the opened state. The two spreading tool halves 16, 17 of the door-opening tool are attached to the two additional tool halves 18, 19. The additional tool halves 18, 19 form a preferably toothed cutting profile 37, 38 (see also FIG. 5), which makes it possible to cut through a door chain after the door or window is opened by means of the door-opening tool.

Furthermore, it can be seen from FIG. 3 that a preferably transversely extending nonslip contour 40*a*, 40*b* is provided—in the form of a knurl, for example—in the vicinity of the flattened or flat wall portion 20*a* of the spreading tool half 16. It is provided so that a contact extension, such as a crowbar, for example, is provided with a hold and does not slip off. In addition, between the flattened rear-side region and the individual front-side wall portions 20*b*, the spreading tool half 16 has a wall region 41 that is oriented at an angle in relation to the wall portions 20*b* and serves as a stop.

Figure 4:
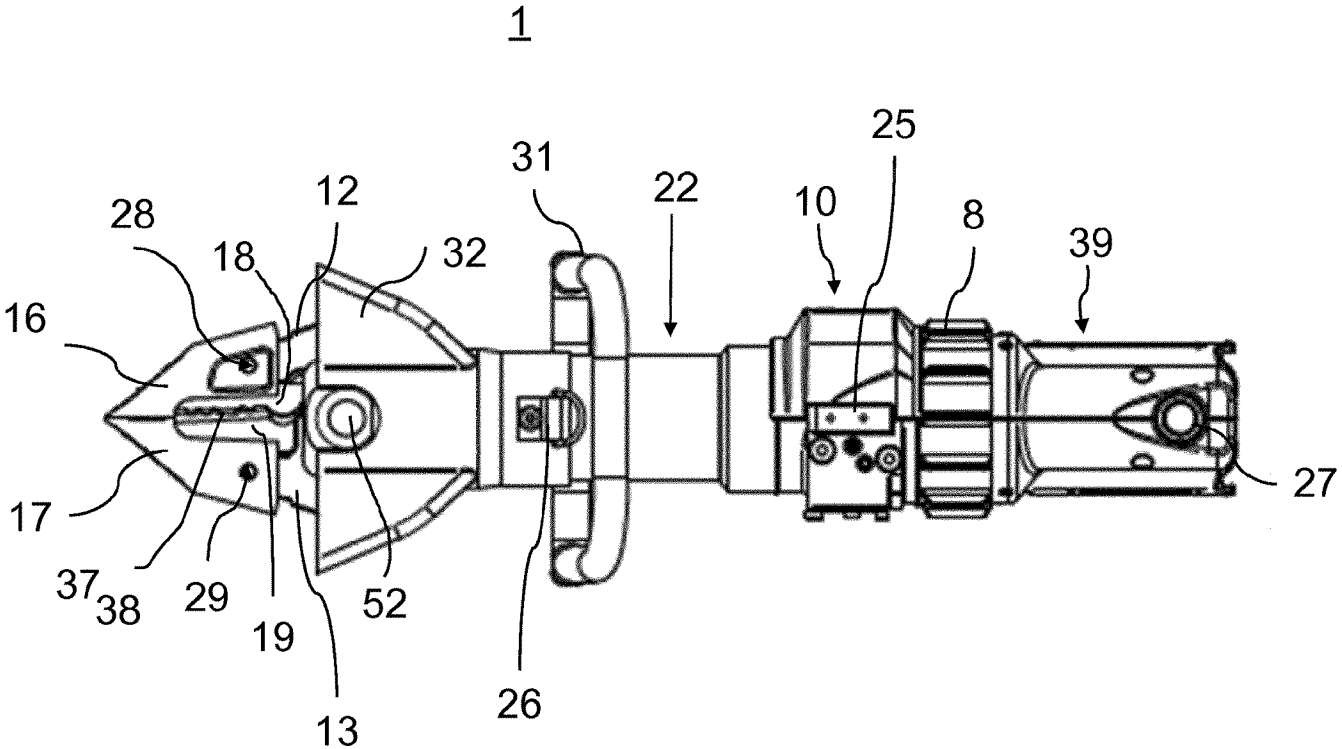
FIG. 4 shows a top view of a second embodiment of the hydraulic implement not belonging to the invention.

FIG. 4 shows an embodiment of the implement 1 in which, instead of the door-opening tool of the embodiment according to FIGS. 1 to 3, a spreading tool with a triangular outer contour is located on the front side of the implement 1. This spreading tool possesses two spreading tool halves 16, 17 and is also attached to the two additional tool halves 18, 19 in the aforedescribed manner. The type of locking is the same as in the embodiment of FIGS. 1 to 3. The toothed cutting profile 37, 38 of the two additional tool halves 18, 19 is readily visible.

Figure 5:
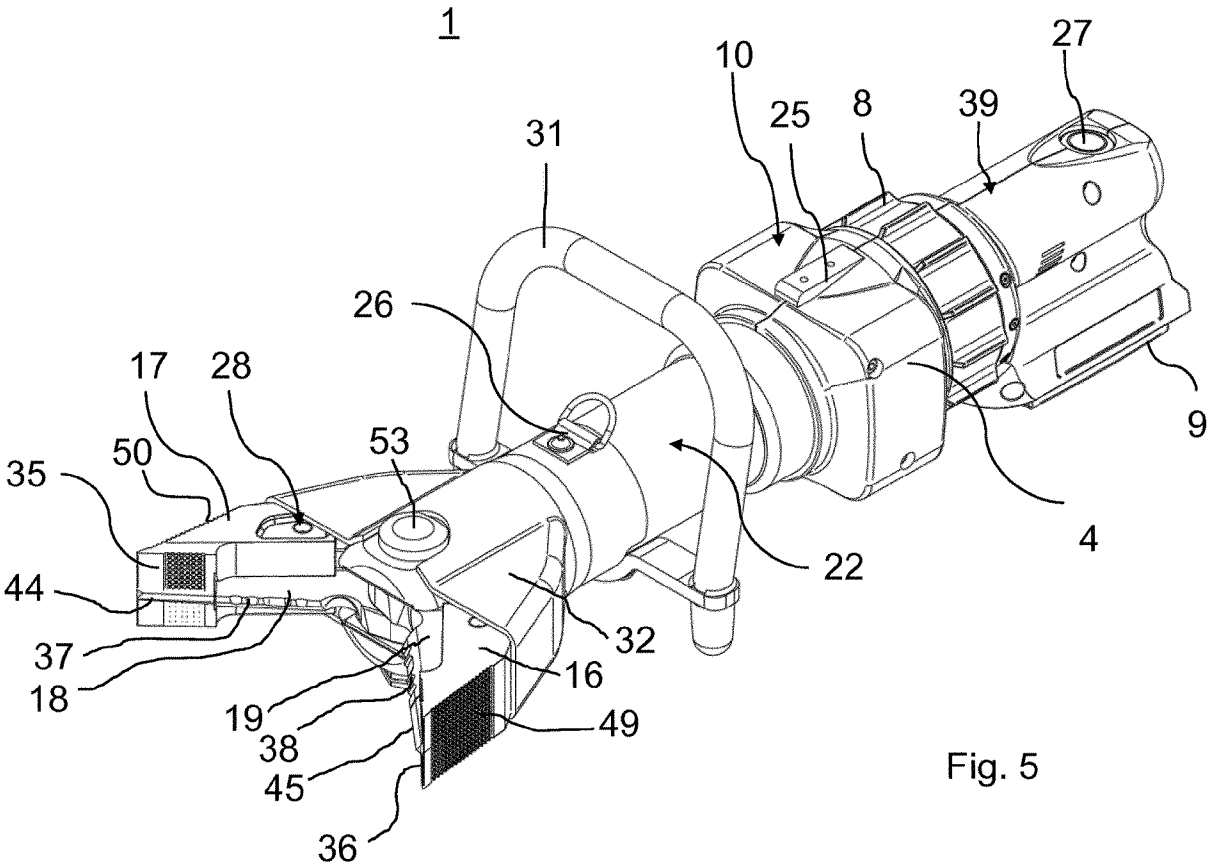
FIG. 5 shows a perspective view of the embodiment of the hydraulic implement according to FIG. 4 with opened tool halves.

As can be seen from FIG. 5, the spreading tool halves 16, 17 have an outer surface 49, 50 in the outer region that can be preferably provided with a profile. Furthermore, the two spreading tool halves 16, 17 each have a contact surface 35, 36 on the inside, which can also have a profile. The contact surface 35, 36 is interspersed with a cutting profile 44, 45 that extends to the tip of the two spreading tool halves. The cutting profile 44, 45 is preferably rectilinear and can also project slightly over the plane of the contact surfaces 35, 36. As can be seen from FIG. 5, the cutting profile 44, 45 can lie in the extension of the cutting profile 37, 38 of the two additional tool halves 18, 19 to which the spreading tool halves 16, 17 are attached.

Figure 6:
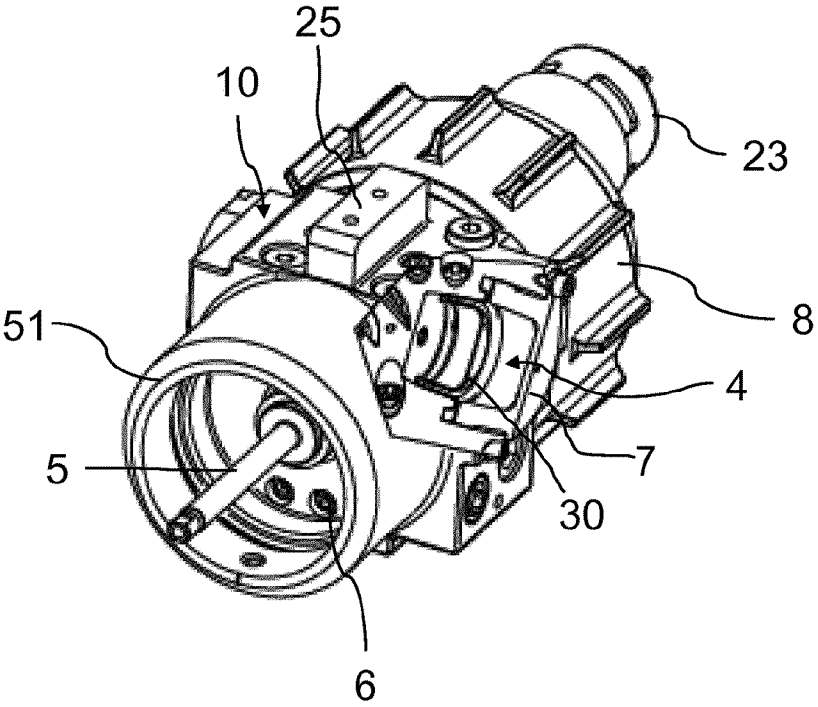
FIG. 6 shows a perspective view of the pump housing including the control valve of the hydraulic implement according to the invention.

The illustration according to FIG. 6 shows a partial representation of the pump housing 10, and of the control valve 8 without motor housing and with partially covered electric motor 23 inserted. The pump housing 10 has a ring-like projection 51 that serves to ensure a connection of the cylinder housing 22 to the pump housing 10. Also visible is the hollow rod 5 on the pump housing 10, which simultaneously serves as a line for the hydraulic fluid toward the second cylinder space 46*b*. Numeral 6 refers to additional hydraulic lines that lead from the pump housing 10 to the first cylinder space 46*a* (cf. FIG. 1).

The implement according to the invention has a hydraulic tank 4, which is accommodated in the pump housing 10. For this purpose, the pump housing 10 comprises an opening that can be closed by a lid 7 in which a compensating device is located, for example in the form of a cup-shaped rubber diaphragm 30.

The lid 7 can be connected to the pump housing 10 using screws. The holding fixture 25 for the illumination unit to be mounted is located on the top side.

Figure 7:
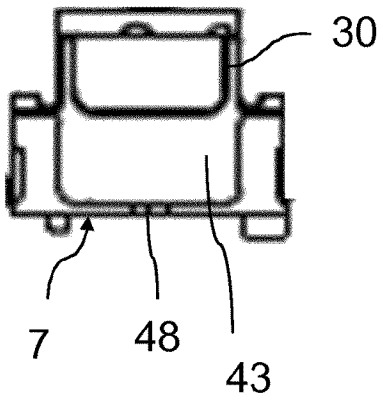
FIG. 7 shows a sectional view through the hydraulic tank of the hydraulic implement according to the invention.

FIG. 7 shows an enlarged representation of the tank 4 of the implement. As can be seen, the lid 7 forms, together with the underlying pump housing 10, a compensation chamber 43 into which the compensating device in the form of the rubber diaphragm 30, for example, extends more or less depending on the position of the hydraulic cylinder 3. The pump housing 10 thus comprises a tank 4 that simultaneously represents the compensation volume 43 for the rubber diaphragm 30. In this way, the weight of the implement can be reduced substantially. An opening 48 is located in the lid 7 that makes it possible for air to escape into the compensation chamber 43 when the rubber diaphragm 30 expands.

FIG. 8 shows enlarged partial representations of a coupling 28 for manually locking and unlocking the spreading tool halves 16, 17 to be attached to the additional tool halves 18, 19 in various states. FIG. 8*a* shows the locked spreading tool halves, FIG. 8*b* shows the unlocked spreading tool halves, and FIG. 8*c* shows the spreading tool halves in the state of pushing-in or pushing-off.

FIG. 8*a* shows the second tool half 18, which is inserted into a recess 65 of the spreading tool half 16. FIG. 8*a* shows the locked state in which the spreading tool half 16 and the additional tool half 18 are securely interconnected by the coupling 28. The coupling 28 comprises a large-surface, plate-shaped actuation element 56 that is located in a recess 57, a ring 58 (see FIG. 8*b*), and a locking element 53. The locking element 53 is located in a hole 54 of the additional tool half 18 and is biased by a spring 55 in the direction toward the actuation element 56.

In the embodiment shown here, the actuation element 56 has a preferably annular projection 60 that coacts with a correspondingly annular recess 62 so that the actuation element 56 can be pressed. Expediently, the actuation element 56 has an additional center projection 67 that lies opposite a hole 66 on the spreading tool half 16. The hole 66 is expedient for creating space for the locking element 53 in order to lock the spreading tool halves 16, 17 in place. The purpose of the projection 67 is, upon actuation of the actuation element 56, to displace the locking element 53 out of the hole 66 against the force of the spring 55 into the hole 54. This enables the coupling 28 to be unlocked. An annular projection 61 is located next to the hole 66. A corresponding recess 63 lies opposite the projection 61 in the actuation element 56. Upon actuation of the actuation element 56, the projection 61 is sunk into this recess 63. The actuation element 56 is thus guided.

FIG. 8*b* shows the unlocked state. The locking element 53 is completely sunk into the hole 54, and the actuation element 56 is pressed in by the operator. The actuation element 56 has an annular recess 59 on the outside. In the locked position (FIG. 8*a*), the recess 59 is filled by the ring 58, and an actuation plane of the actuation element 56 is thus created that is flush with the surface of the tool 18.

FIG. 8*c* clarifies how the spreading tool half 16 can be attached to the additional tool half 18 and how they can be separated from one another. As a result of the force of the spring 55 during the retraction of the additional tool half 16, the locking element 53 is pressed out of the hole 54 at the beginning of a chamfered edge 64 located on the spreading tool half 18. The chamfered edge acts as an insertion chamfer during the placement of the spreading tool half 16 onto the additional tool half 18, and, during attachment, the locking element 53 is pressed by virtue of the chamfered edge 64 into the hole 54 and then plunged into same once the hole 66 is reached. In this way, the spreading tool half 16 is locked with the additional tool half 18.

The implement according to the invention is characterized by a low weight and small dimensions. Moreover, it offers a very high level of variability of use and is therefore very especially suitable as an accompanying tool for firefighters that enables quick access into a building. The implement according to the invention is also very especially suitable for use by special task forces.

LIST OF REFERENCE SYMBOLS

1 Implement
2 Hydraulic pump
3 Hydraulic cylinder
4 Hydraulic tank
5 Hollow rod
6 Hydraulic line
7 Lid
8 Control valve
9 Rechargeable battery
10 Pump housing
11 Piston rod
12 swivel arm
13 swivel arm
16 Spreading tool half
17 Spreading tool half
18 Additional tool half
19 Additional tool half
20 Portion
20*a* Wall portion
20*b* Wall portion
21 Portion
21*a* Wall portion
21*b* Wall portion
22 Cylinder housing
23 Electric motor
24 Flattened front region
25 Holding fixture for illumination unit
26 Harness support
27 Main switch
28 Coupling
29 Coupling
30 Rubber diaphragm
31 Handle
32 Protective cover
33 Harness support
34 Chamfer
35 Contact surface
36 Contact surface
37 Cutting profile
38 Cutting profile
39 Motor housing
40*a* Contour
40*b* Contour
41 Wall region
42 Flow opening
43 Compensation volume
44 Cutting profile
45 Cutting profile
46*a* First cylinder space
46*b* Second cylinder space
47 Hole
48 Lid opening
49 Outer surface
50 Outer surface
51 Annular projection
52 Pin
53 Locking element
54 Hole
55 Spring
56 Actuation element
57 Recess
58 Ring
59 Recess
60 Projection
61 Projection
62 Recess
63 Recess
64 Chamfered edge
65 Recess
66 Hole
67 Projection

The invention claimed is:

1. A hydraulic implement for portable use, comprising:
a hydraulic pump;
a pump housing:
a hydraulic cylinder with a piston rod:
a hydraulic tank:
hydraulic lines:
a compensation device:
a manually operable, hydraulic control valve:
a rechargeable battery accommodated on the implement:

two tool halves connected to the piston rod via pivoting arms, wherein the tool halves comprise spreading tool halves:

each spreading tool half has a wall portion extending perpendicular to a longitudinal axis of the piston rod, wherein when the two spreading tool halves are in a closed state, the two wall portions form together a flattened front region running perpendicular to an extension of the longitudinal axis of the piston rod:

the flattened front region is oriented so as to be laterally offset and skewed in relation to the extension of the longitudinal axis of the piston rod, wherein the tool halves have a cutting profile.

2. The implement as set forth in claim 1, wherein a tip of the flattened front region has a chamfer.

3. The implement as set forth in claim 1, wherein the spreading tool halves engage in or over one another in a vicinity of the flattened front region.

4. The implement as set forth in claim 3, wherein the spreading tool halves have a plurality of wall portions which, in lying one over the other, form the flattened front region.

5. The implement as set forth in claim 1, wherein the portion has at an end opposite the front region at least one flattened wall portion.

6. The implement as set forth in claim 5, wherein at least one flattened wall portion has at least one contour.

7. The implement as set forth in claim 1, wherein the spreading tool halves are attachable to pivoting arms.

8. The implement as set forth in claim 1, wherein the additional tool halves are attachable to the spreading tool halves.

9. The implement as set forth in claim 8, wherein a manual, toollessly operable coupling is provided between the spreading tool halves and the additional tool halves.

10. The implement as set forth in claim 8, wherein a spring-loaded locking element is accommodated in a hole in each of the spreading tool halves, and the additional tool halves each comprise a plate-shaped actuation element for the locking element.

11. The implement as set forth in claim 8, wherein the actuation element has a projection that lies opposite a hole on the additional tool halves and the hole serves to receive the locking element in a locked state.

12. The implement as set forth in claim 8, wherein the additional tool half has a chamfered edge that acts as an insertion chamfer for the locking element.

13. The implement as set forth in claim 1, wherein the additional tool half comprises the cutting profile.

14. The implement as set forth in claim 1, the cutting profile extends to a tip of the additional tool half.

15. The implement as set forth in claim 1, wherein a compensating device and a hydraulic tank are provided which are located in the pump housing.

16. The implement as set forth in claim 1, wherein the pump housing has a lid, wherein the lid together with the pump housing, forms a compensation chamber into which the compensating device extends.

17. The implement as set forth in claim 1, wherein a holding fixture for an illumination unit is located on the pump housing.

* * * * *